United States Patent [19]

Stemmler et al.

[11] Patent Number: 4,917,365

[45] Date of Patent: Apr. 17, 1990

[54] METHOD AND APPARATUS FOR DIVIDING A MOVING STACK OF FLEXIBLE WORKPIECES INTO PARTIAL STACKS COMPRISING A PREDETERMINED NUMBER OF WORKPIECES

[75] Inventors: Kurt Stemmler; Egon Marth, both of Neuwied, Fed. Rep. of Germany

[73] Assignee: Winkler & Dunnebier Maschinenfabrik & Eisengiesserei KG, Neuwied, Fed. Rep. of Germany

[21] Appl. No.: 218,313

[22] Filed: Jul. 12, 1988

[30] Foreign Application Priority Data

Jul. 18, 1987 [DE] Fed. Rep. of Germany ..... 3723866

[51] Int. Cl.[4] ..... B65H 41/00

[52] U.S. Cl. ..... 270/52.5; 493/22; 270/39

[58] Field of Search ..... 493/30–31, 493/11, 22, 343, 409–411, 413–416; 270/39, 40, 41, 52, 52.5

[56] References Cited

U.S. PATENT DOCUMENTS

| | | | |
|---|---|---|---|
| 2,761,676 | 9/1956 | Sabee | 270/39 |
| 2,761,677 | 9/1956 | Rutkus | 270/39 |
| 3,829,080 | 8/1974 | Braen | 493/11 |
| 4,721,295 | 1/1988 | Hathaway | 270/52.5 |
| 4,730,762 | 3/1988 | Felix | 270/39 |
| 4,770,402 | 9/1988 | Couturier | 270/39 |

FOREIGN PATENT DOCUMENTS

| | | | |
|---|---|---|---|
| 978441 | 11/1975 | Canada | 493/11 |
| 53466 | 4/1979 | Japan | 493/22 |

*Primary Examiner*—Robert E. Garrett
*Assistant Examiner*—Therese M. Newholm
*Attorney, Agent, or Firm*—Collard, Roe & Galgano

[57] ABSTRACT

There is provided a method and apparatus for dividing a moving stack of flexible workpieces, such as paper hand towels, face towels and the like, which are interfolded with one another in a zigzag manner, into partial stacks comprised of predetermined numbers of such workpieces, and for transferring such partial stacks to a depositing table. One of the material webs participating in the manufacture of the flexible workpieces is first marked, the spacing between the marks being adjusted to correspond with the number of towels required in the partial stack. Downstream of the folding device, the stack formed thereby is reversed upwardly and scanned by an optical detector which reads the marking and controls a separating blade, which is driven into the stack and lifted. The gap formed by the separating blade is engaged by lifting forks, which lift the partial stack to the level of the depositing table, where the partial stack is taken over by transport forks and guided across the depositing table. The transport forks then return to their starting position, whereas the partial stack is retained on the depositing table by a retaining pin.

5 Claims, 6 Drawing Sheets

METHOD AND APPARATUS FOR DIVIDING A MOVING STACK OF FLEXIBLE WORKPIECES INTO PARTIAL STACKS COMPRISING A PREDETERMINED NUMBER OF WORKPIECES

The present invention relates to a method and apparatus for dividing a driven stack of flexible workpieces into partial stacks each comprising a predetermined number of such workpieces, and, more particularly, it relates to the manufacture of towels, such as face towels, paper hand towels and the like, which are interfolded with one another in a zigzag manner.

The workpieces or towels described above are manufactured on machines, into which the starting material is fed in the form of endless webs of material. In a folding and cutting device, the webs are separated into individual towels and folded into one another in a zigzag manner. The products exit from the folding and cutting equipment in the form of an endless, moving stack. The way in which the products are folded into one another makes it difficult to divide the stack. The equipment used in the manufacture of similar products, such as napkins or handkerchiefs, which are not interfolded with one another, such equipment being, for example, a chain of compartments or a fan-shaped disk for forming partial stacks, cannot be used in the present case. Because of this, prior to the present invention, partial stacks of towels interfolded with one another in a zigzag manner have been formed by hand. In the forming of such partial stacks, the webs of material participating in the manufacture of the towels are marked, the markings being controlled by a counting device. The markings are detectable on the stack and they inform the operator where the stack is to be divided or separated. Obviously, the drawback of this procedure is the high labor cost connected with the operation of such equipment.

It is, therefore, the object of the present invention to provide a method and apparatus for carrying out such method that permits dividing a driven stack of flexible workpieces, such as face towels, paper hand towels and the like, such towels being interfolded with one another in a zigzag manner, into partial stacks, and to unload such partial stacks, for example, on a depositing table or directly into a packaging machine.

The above object is accomplished in accordance with the present invention by a method and apparatus which performs the following steps:

(a) detection of a marking provided on the endless stack of workpieces and the generation of a control pulse;

(b) separation of the stack within the zone of the marking;

(c) acceleration of the partial stack disposed in front of the separating gap in the direction of motion, to a higher speed than that of the remaining stack; and (d) discharge of the partial stack.

The steps indicated above permit automation of the entire process of forming and discharging partial stacks of such interfolded workpieces and thus the savings of the above indicated high labor costs.

Furthermore, accurate aiming and reliability are accomplished by spatially combining the detector and the separating tool and the nearly inertia-free reaction of these elements to each marking, such that the result is that the towels forming a partial stack are present in the exact unit numbers corresponding to the predetermined number.

The apparatus for carrying out the method according to the present invention comprises means for detecting a marking provided on the stack; means for separating a partial stack from the total stack; and means for unloading and depositing a partial stack. The means for detecting a marking provided on the stack is a detector reacting to optical signals; the means for separating a partial stack from the total stack is a separating blade designed for pivotal movement and lifting; and the means for unloading and depositing a partial stack comprises swinging and lifting forks which, in cooperation with transport forks, operate on a depositing table equipped with a retention device.

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

Figure 1:
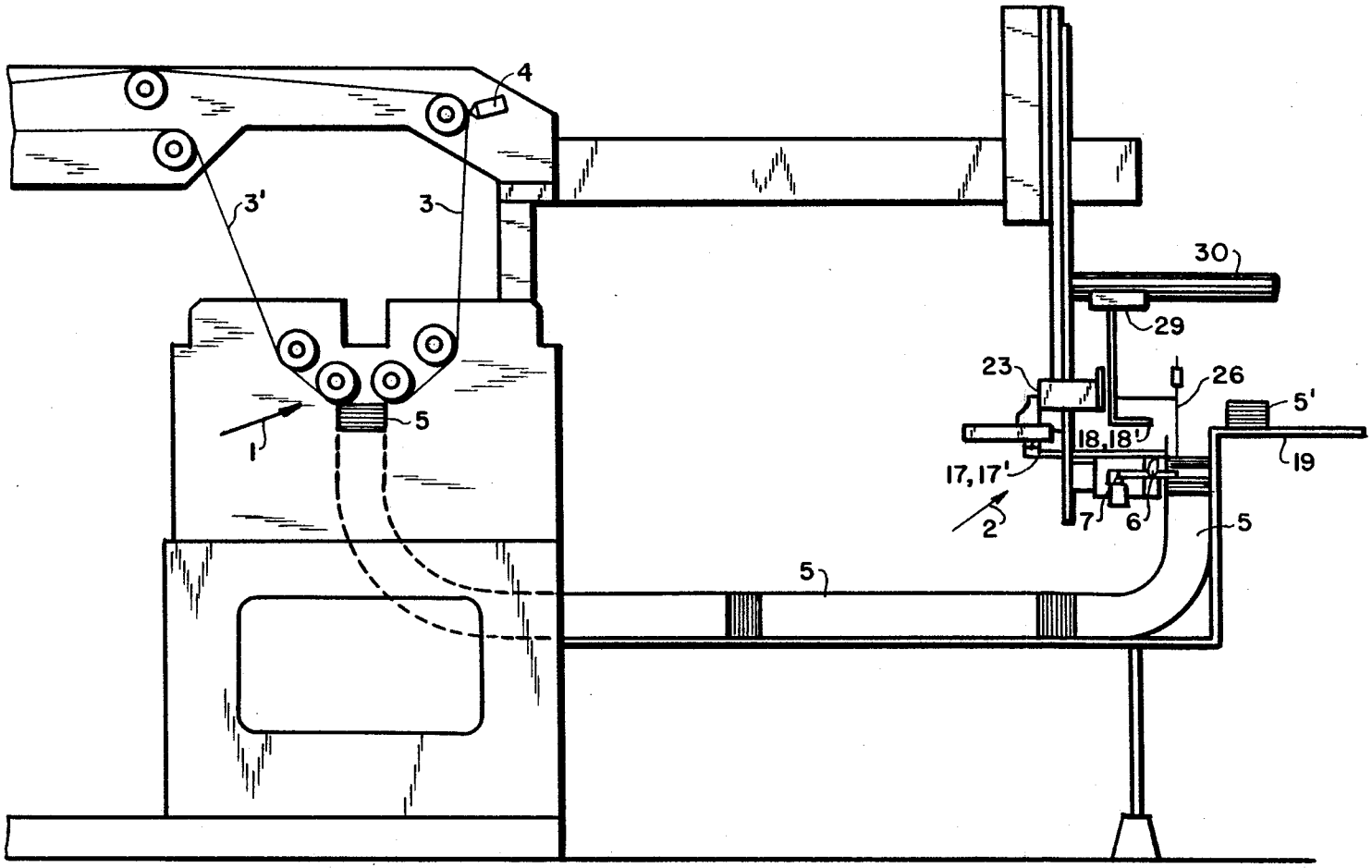
FIG. 1 is a schematic side view of a machine for producing towels interfolded with one another in a zigzag manner.

Now turning to the drawings, there is shown in FIG. 1, a schematic view of a machine for producing towels which are interfolded in a zigzag manner, highlighting the device that is of special interest in the present case. This machine basically consists of a cutting and folding device 1 and device 2 for forming the partial stacks. The two material webs 3 and 3' are fed into the cutting and folding device. A marking device 4 is arranged above material web 3 and is controlled by a counter or the like (not shown in the drawing) for producing on material web 3 optical markings in the form of bars, using a color that is normally invisible to the human eye and illuminating only under the influence of UV-light. Material web 3 so marked is combined with unmarked material web 3' within the region of cutting and folding device 1, where it is separated in the manner known per se into individual cut units and folded in a zigzag manner, in which the individual units engage one another or are interfolded with one another. The towels so folded into one another are first passed downwardly in the form of an endless stack 5, then reversed to the horizontal line, and finally passed upwardly in the vertical direction following another reversal. The partial stacks are formed within the last-mentioned zone, in which the device 2 for forming the partial stacks is arranged and which is shown in greater detail in FIG. 2. This device basically comprises three main elements:

(a) means for detecting the markings on web 3;

(b) means for separating partial stacks from endless stack 5; and (c) means for unloading or discharging and depositing the partial stacks.

Figure 2:
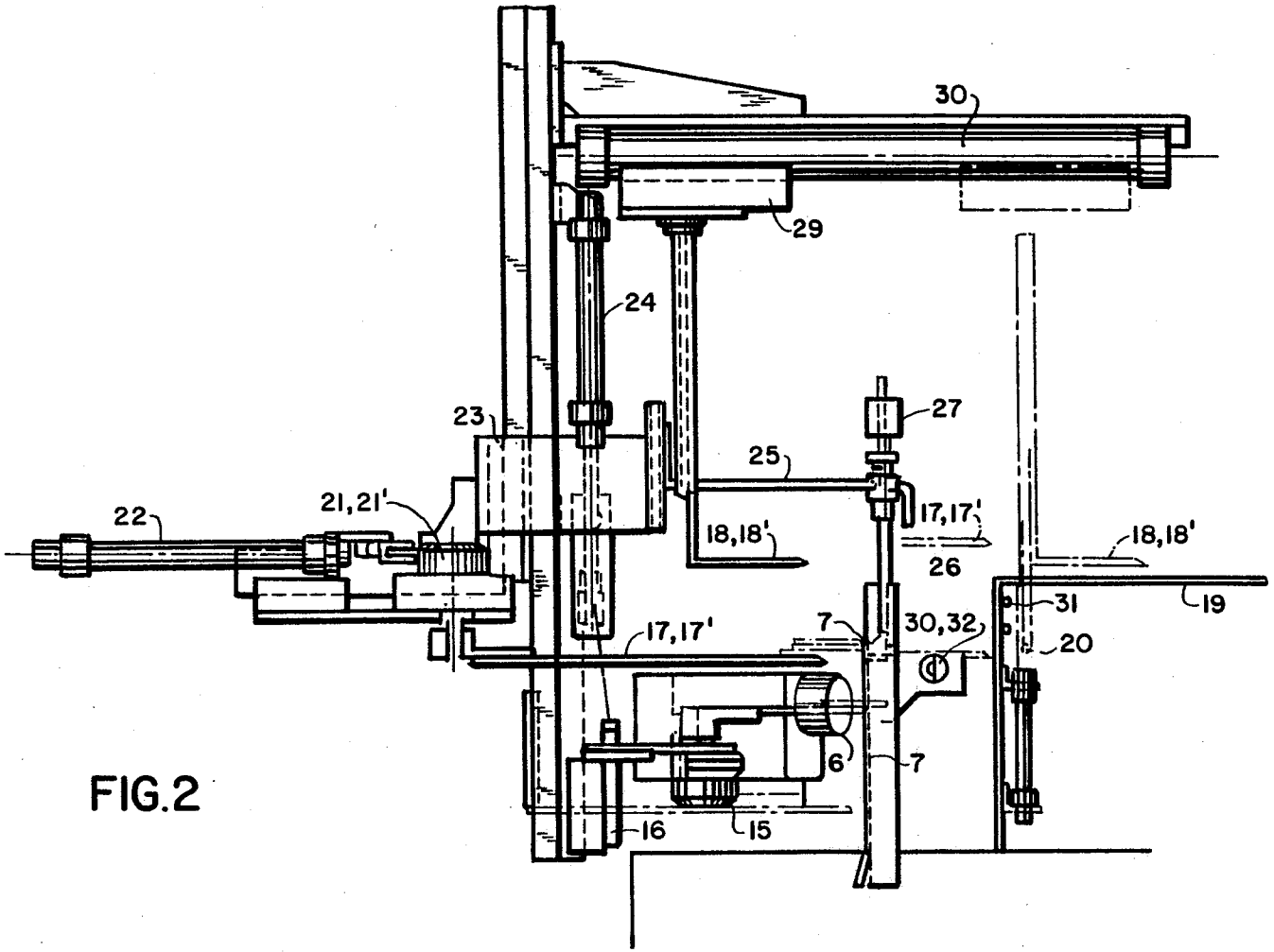
FIG. 2 is an enlarged view of a portion of the machine shown in FIG. 1, showing the means for dividing a stack into partial stacks shown in FIG. 1.
Figure 3:
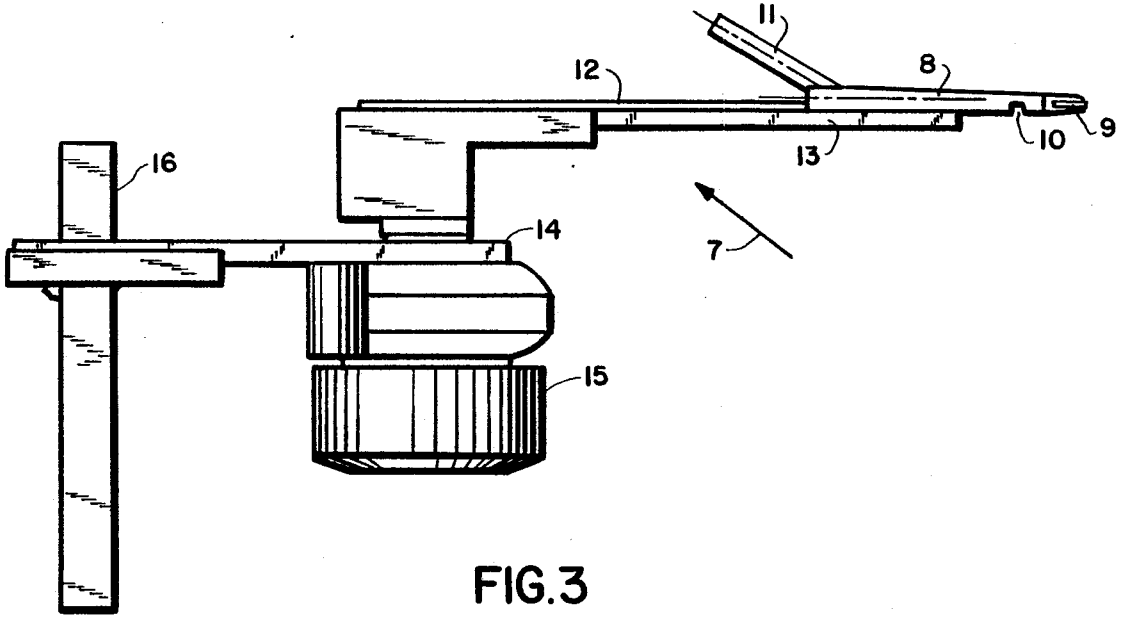
FIG. 3 is an enlarged side view of a separating blade.

The means for detecting the markings is a detector 6, which reacts to optical signals. The optical system of this device, as clearly seen in FIG. 2, is arranged proximate to stack 5 passing by the device in order to assure high accuracy. Once a marking has been detected by detector 6, the latter triggers a control pulse, which actuates the means for separating a partial stack. The most important element of the separating means is a separating blade 7, which is capable of being driven into the stack and lifted. As clearly seen in FIG. 3, separating blade 7 has at the point of its front part 8, a slotted nozzle 9, and suction air bores 10 arranged on its bottom side. Slotted nozzle 9 and the suction air bores 10 are connected (not shown in the drawing) to a compressed air and vacuum source by a common connection conduit 11. Front part 8 of separating blade 7 is resiliently supported on a leaf spring 12. For accurately fixing the basic position of front part 8, the latter rests on a supporting strip 13. Any movement of front part 8 against the action of leaf spring 12 from its resting position is thus possible only in one direction, that is, in the direction of upward motion of the stack. Separating blade 7 is supported in such a way that it is capable of pivotal movement and vertical displacement, for which purpose its rear end is seated on drive axle 14 of rotary cylinder 15. The latter in turn is fastened on a plate 16, which can be lifted or lowered by means of a pneumatic cylinder (not shown). The pivotal movement performed by separating blade 7 is in the order of 30° ; the lifting motion is performed over a distance of about 5 centimeters.

In its starting position, the point of separating blade 7 is close to stack 5 and near the optical system of detector 6, but not yet acting on the stack. As soon as a marking passes by the optical system of detector 6, the latter triggers a control pulse, which first opens the feed of compressed air to slotted nozzle 9 on the front part 8 of separating blade 7. The small distance between the point of separating blade 7 and stack 5 permits the compressed air to intensively act on the stack and to loosen up the region which the separating blade has to penetrate. Practically simultaneously with the opening of the compressed air valve, the control pulse triggers the pivotal movement of separating blade 7, causing the point of the latter to penetrate the "preopened" stack, such opening having been produced by the compressed air, and to advance to about the center of the stack. Upon reaching the center of the stack, the pivotal movement ends and a subsequent pulse activates the pneumatic cylinder for the lifting motion. As mentioned before, pneumatic cylinder engages plate 16 and lifts the latter together with rotary cylinder 15, the latter being attached to the plate, by about 5 centimeters. This creates in the stack a gap of a few centimeters height within the region of the tip of separating blade 7. At this point, this gap is engaged by means for discharging and depositing the partial stacks, and the partial stack is taken over thereby. Separating blade 7 is now no longer needed in this location, so that it is lowered again, but not yet pivoted back into its starting position. With its resilient front part 8, separating blade 7 comes to rest on the top sheet of the remaining stack and slightly forces this sheet against its support under the action of the spring force. Separating blade 7 remains in this position until the partial stack disposed above the blade has been discharged. The action of separating blade 7 during this step and thereafter is explained hereinafter in greater detail in connection with the means for unloading and depositing the partial stacks, and in connection with other features of the invention.

The means for unloading and depositing the partial stacks, as clearly seen in FIGS. 2 and 4, is basically comprised of a pair of swinging lifting forks 17 and 17', a pair of transport forks 18 and 18', and a depositing table 19, the latter having a retention device 20 arranged at its front edge. In the starting position shown in FIG. 4A, swinging lifting forks 17 and 17' are disposed (as viewed from the top) centrally above the point of rotation of separating blade 7, with the tips of the forks being swung toward one another in a way such that the spacing between the tips is slightly greater than the width of separating blade 7. Viewed from the side, the lifting forks are disposed slightly below the level of the lifted separating blade 7. At their ends averted from the stack, lifting forks 17 and 17' are supported in a way similar to the support of separating blade 7, that is, in a manner permitting them to pivot on rotary cylinders 21 and 21' (FIG. 2). The range of pivoting movement is limited so that the lifting forks can be swung from their aforedescribed starting position into a position in which the forks are aligned approximately at right angles relative to the front edge of the stack, and parallel with one another. Swinging lifting forks 17 and 17' can be displaced sideways, i.e., against the stacks and into the latter, and from this position back into their starting positions. The final positions of this path are shown in FIG. 2. In the starting position, the tips of the forks are outside the stack close to its leading edge. This position is shown in FIG. 2 by the solid lines. In the retracted condition, i.e., displaced to the right, they are deep in the stack and approximately flush with the trailing edge of the stack. This position is shown in FIG. 2 by the phantom lines. The force required for the displacement motion is generated by a pneumatic cylinder 22. In addition, swinging lifting forks 17 and 17' are liftable. For lifting, the lifting forks and the rotary cylinders 21 and 21' and the pneumatic cylinder 22 all are mounted on a displaceable carriage 23, which is guided in guides not shown in detail, and liftable by a pneumatic cylinder 24 from the position shown in FIG. 2 to an extent such that the swinging lifting forks 17 and 17' are disposed above the top edge of depositing table 19.

A suppressing means 26, which is loaded by a weight 27 plugged over such means, is fastened via a jib-like support 25 on the carriage 23 as well. This suppressing element 26 comes to rest on the endless stack when the lifting forks are in the lowered position, and it stabilizes the lifted partial stack 5', following the lifting motions of lifting forks 17 and 17' until the partial stack 5' has been taken over by transport forks 18 and 18'.

Transport forks 18 and 18' are disposed slightly beneath lifted lifting forks 17 and 17', but still above the top edge of depositing table 19. Transport forks 18 and 18' are capable of performing a motion sideways as shown in FIG. 2, from a waiting position ahead of the leading edge of the lifted partial stack 5' into a position above depositing table 19. For this purpose, they are fastened on a carriage 29, which is movable along a track 30 by means of a pneumatic cylinder (not shown). The waiting position of transport forks 18 and 18' is shown in FIG. 2 in solid lines and the position above depositing table 19 is indicated by the phantom lines.

In operation of the transporting system, after separating blade 7 has separated and lifted a partial stack, swinging lifting forks 17 and 17', with their fork tips swung toward one another, are driven on the left and right of separating blade 7 and close to the latter into the gap formed in the stack, and only slightly deeper into the gap than the separating blade 7, as seen in FIGS. 4C to H. At this point the lifting forks are swung apart (FIGS. 4I and 4J) and take over the partial stack from separating blade 7 on the left and right sides. Simultaneously, separating blade 7 is lowered again and, with the bottom side of its front part 8, comes to rest on the top sheet of endless stack 5, stabilizing the latter. The force of leaf spring 12 is supported by the action of vacuum acting through bores 10, to keep the top sheet firmly in place. Front part 8 of separating blade 7, due to its resilient support, follows the growth of stack 5 without noticeable change of the acting force.

Once partial stack 5' has been completely separated from stack 5 by lifting forks 17 and 17', which move upwardly and discharge the partial stack, the feed of vacuum to bores 10 on the bottom side of separating blade 7 is interrupted. The separating blade is slightly lifted in order to be clear of stack 5 and pivoted back into its starting position ahead of the leading edge of the stack, while lifting forks 17 and 17' continue their upward movement until the bottom edge of partial stack 5', which is carried along by the forks, comes to rest distinctly above the top edge of depositing table 19. This position of lifting forks 17 and 17' is indicated in FIG. 2 by the upper phantom lines. Next, transport forks 18 and 18' are activated and move from their waiting position against partial stack 5', which has been lifted by lifting forks 17 and 17', and grip under stack 5', taking it over from the lifting forks and transporting it to the right into a position close above the level of depositing table 19. At this point, the direction of motion of transport forks 18 and 18' is reversed. The retention device 20 exits through depositing table 19 and retains the partial stack, while transport forks 18 and 18' return to their starting position. At the same time, lifting forks 17 and 17' have already returned to their starting positions. This return movement has already started at about the point in time at which the partial stack was taken over by transport forks 18 and 18'.

The motions illustrated schematically in FIG. 4 are explained in the following in greater detail to show how separating blade 7 cooperates with the device for discharging and depositing the partial stacks.

Figure 4A:
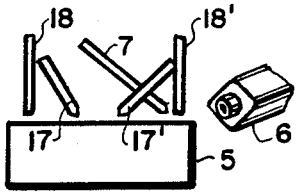
FIGS. 4A to 4N and 4P to FIG. 4S are schematic representations of the motions of the apparatus for forming the partial stacks, such motions being divided into nine steps each being shown in plan view and in elevational view.
Figure 4C:
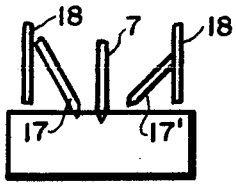
Figure 4E:
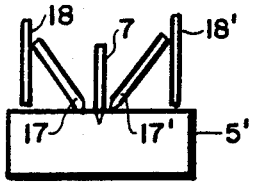
Figure 4G:
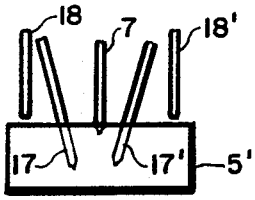
Figure 4I:
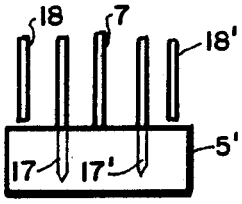
Figure 4B:
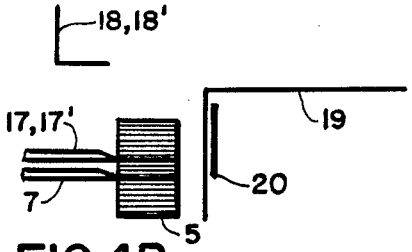
Figure 4D:
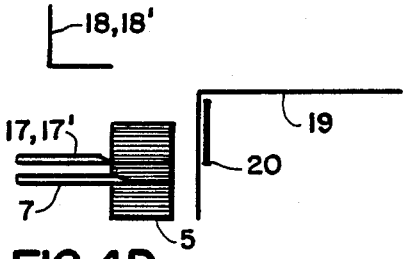
Figure 4F:
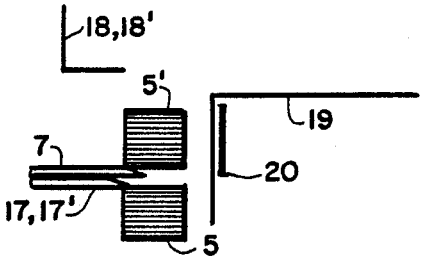
Figure 4H:
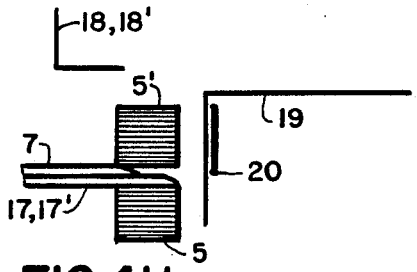
Figure 4J:
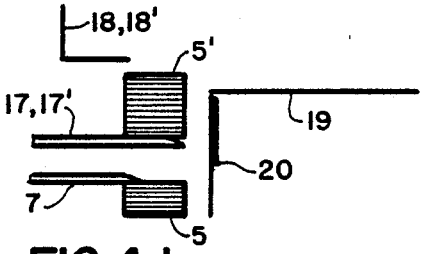
Figure 4K:
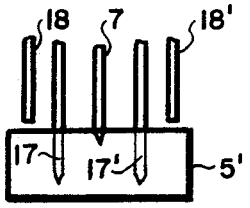
Figure 4L:
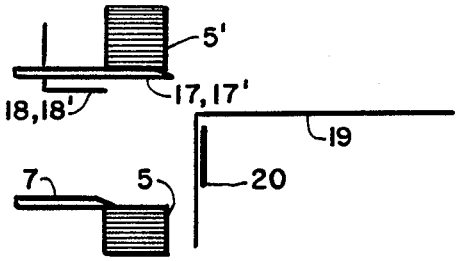
Figure 4M:
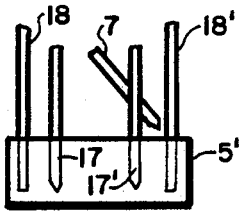
Figure 4N:
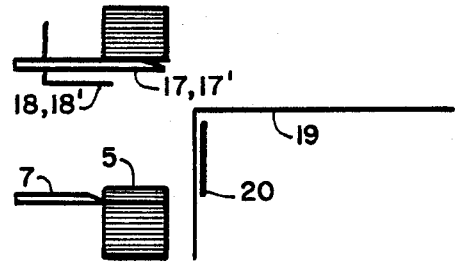
Figure 4P:
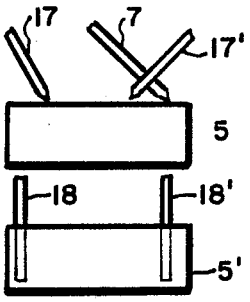
Figure 4Q:
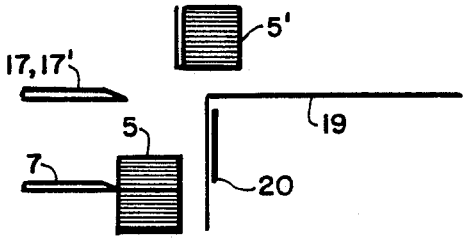
Figure 4R:
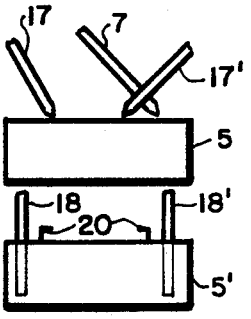
Figure 4S:
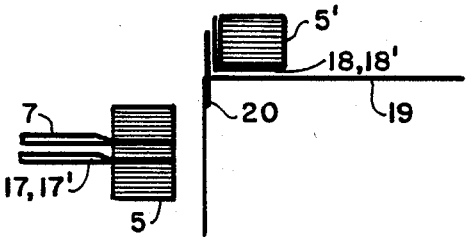

A single operating cycle has been broken down into nine steps and shown in FIGS. 4A to 4S; each step showing a plan and a side view.

In the step shown in FIGS. 4A and 4B, all elements are in their starting positions. Separating blade 7 is pivoted out and, with its front part, is close to stack 5. Swinging lifting forks 17 and 17' are lowered and, with their tips swung toward one another, are close to the stack 5 as well, slightly above separating blade 7. Transport forks 18 and 18' are in their rearward positions and retention device 20 is retracted from the surface of depositing table 19.

As soon as a marking passes the optical system of detector 6, separating blade 7 pivots inwardly, which is shown in FIGS. 4C and 4D, penetrating stack 5 with its front part. Subsequently, in the step shown in FIGS. 4E and 4F, separating blade 7 is lifted to a level slightly above the height of lowered lifting forks 17 and 17'. In the step shown in FIGS. 4G and 4H, swinging lifting forks 17 and 17' are driven into the gap formed by separating blade 7. Lifting forks 17 and 17' now pivot their tips apart and in this way take over partial stack 5', which has been lifted by separating blade 7. The latter is no longer needed in this location and, therefore, is lowered. With its resilient front part, separating blade 7 comes to rest on endless stack 5, stabilizing the latter. This position is shown in FIGS. 4I and 4J.

Swinging lifting forks 17 and 17' are lifted and carry partial stack 5', as shown in FIGS. 4K and 4L, to a level disposed above the front edge of depositing table 19 and above the plane of the transport forks 18 and 18'. Transport forks 18 and 18' are displaced to the right, taking over partial stack 5' from the lifting forks and discharging the latter in the direction of depositing table 19. Approximately simultaneously, separating blade 7 is briefly lifted to clear stack 5, and pivoted back to its starting position. The condition reached by these motions is shown in the drawing at FIGS. 4M and 4N.

Transport forks 18 and 18' keep moving, transporting partial stack 5' into a position above depositing table 19. Here, transport forks 18 and 18' come to a halt. Retention device 20 disposed in the front edge of depositing table 19 is activated and exits or projects from the plane of the table, in the present case in the form of a pin 20. At approximately the same time, swinging lifting forks 17 and 17' start their return motion to the starting position, with driving, lowering and pivoting motions taking place simultaneously. This condition is shown in the step shown in FIGS. 4P and 4Q, in which swinging forks 17 and 17' have not as yet completely reached their starting positions. Finally, in the last step shown in FIGS. 4R and 4S, the movement of transport forks 18 and 18' has been reversed.

Partial stack 5' has come to rest against retention device 20 and is just being stripped off the fork. Separating blade 7 and swinging lifting forks 17 and 17' have returned to their starting positions and also transport forks 18 and 18' are returning, so that in the next step the sequence commences again.

According to another feature of the present invention, lifting forks 17 and 17' perform a dual function in that they also perform the function of transport forks 18 and 18'. With this embodiment of the invention, the motions of the lifting forks have been expanded by the movement of the transport forks, i.e., the lifting forks pass through the following cycle of motions: Driving motion into stack 5 with the fork tips pivoted toward one another; outward pivoting of the tips into a substantially parallel position; lifting of the forks and thus of the seized partial stack 5' to a level slightly above the top edge of depositing table 19; displacement of the forks in the direction of depositing table 19 until partial stack 5' comes to rest above depositing table 19; return motion of the forks and unloading of partial stack 5' from the forks by the action of retention device 20; and finally return movement of the transport forks to the starting position.

According to another feature of the present invention, the penetration of the tip of separating blade 7 into the stack is facilitated in that a second motion is superimposed on the pivoting motion of the separating blade, with the rate or speed and direction of the second motion being selected in such a way that at the start of penetration or "immersing" motion, the tip of separating blade 7 substantially performs a movement almost parallel with the leading or front side of the stack and with only a minor component of motion against the stack, resulting in the effect of a "pulled cutting action", which permits the tip of the separating blade to find its way into the gap between two towels effortlessly.

Figure 6:
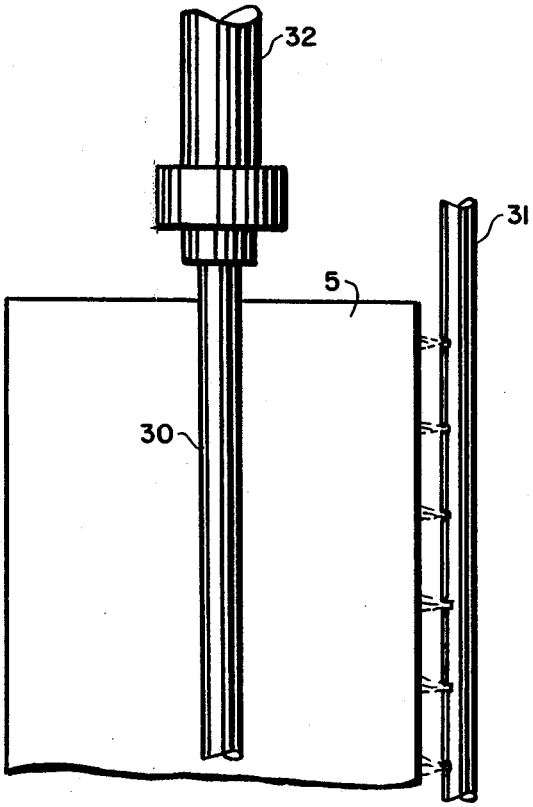
FIG. 6 is a top view of the device shown in FIG. 5.
Figure 5:
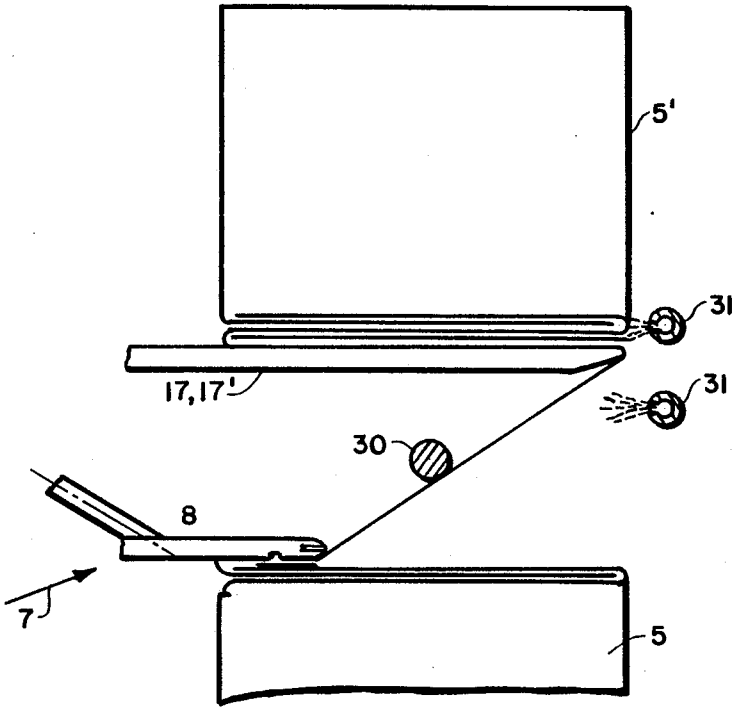
FIG. 5 is a side view of the device for turning over the top sheet of the stack.

According to another feature of the present invention, the device is expanded by means permitting the top sheet of the stack to be turned over, so that the folding edge resulting from such turnover comes to rest approximately in the center of the stack. Thus, upon separation of the stack into partial stacks and packaging of these partial stacks in cardboard or paperboard boxes, this folding edge can be easily gripped through the opening in the box, which opening is normally in the center. The means required for this purpose basically consist of a pneumatically retracted and extended bar or rod 30 and a number of air nozzles 31, which communicate with a compressed air supply source through a controller (not shown). FIGS. 5 and 6 show that in the extended condition, rod 30 extends in the center and parallel with the top edge of the stack and approximately half way between the top edge of endless stack 5 and the bottom edge of partial stack 5' seized by lifting forks 17 and 17'. The length of rod 30 is selected in such a way that in its extended condition, it extends across the full width of the stack and in its retracted condition, it is completely withdrawn from the region of the stack.

Thus, if the top sheet of stack 5 is to be turned over, this action is initiated at the moment at which swinging lifting forks 17 and 17' have taken over or seized a partial stack 5' and started their upward movement, and separating blade 7 has come to rest with its front part 8 on the top sheet of stack 5, which sheet is being acted upon by vacuum admitted by way of the vacuum bores 10, which prevents the sheet from being displaced. Pneumatic cylinder 32 is activated and pushes rod 30 from its rest position outside the boundaries of the stack into its operating position between stack 5 and partial stack 5'. The latter position is clearly shown in FIGS. 5 and 6. Blowing air is emitted by air nozzles 31 at about the same time, while lifting forks 17 and 17' with partial stack 5' continue their upward movement, causing the lowermost sheet of the partial stack, which sheet is still partly folded inwardly under the top sheet of stack 5, to be pulled out. As soon as these sheets have been completely separated, the blowing air exiting from air nozzles 31 cause the now-free part of the top sheet of stack 5 to be turned over around rod 30. The air feed to nozzles 31 is interrupted and rod 30 is retracted, causing the folded top sheet to drop back and to come to rest on stack 5 with its folded edge extending in about the center of the stack.

While only a single embodiment of the present invention has been shown and described, it will be obvious that many changes and modifications may be made thereunto without departing from the spirit and scope of the invention.

What is claimed is:

1. Apparatus for dividing a moving stack of flexible workpieces, having detectable markings thereon, into partial stacks comprised of a predetermined number of workpieces, in particular in the manufacture of towels, such as face towels, paper hand towels and the like, such towels being interfolded with one another in a zigzag manner, said apparatus comprising means for detecting the markings provided on the stack, means for separating a partial stack from the total stack comprising a separating blade wherein the front part of the separating blade includes a nozzle adapted to be operated with blowing air, and means for discharging and depositing a partial stack.

2. Apparatus for dividing a moving stack of flexible workpieces, having detectable markings thereon, into partial stacks comprised of a predetermined number of workpieces, in particular in the manufacture of towels, such as face towels, paper hand towels and the like, such towels being interfolded with one another in zigzag manner, said apparatus comprising means for detecting the markings provided on the stack, means for separating a partial stack from the total stack comprising a separating blade having vacuum bores located at the bottom side of the front part of the separating blade, and means for discharging and depositing a partial stack.

3. Apparatus for dividing a moving stack of flexible workpieces, having detectable markings thereon, into partial stacks comprised of a predetermined number of workpieces, in particular in the manufacture of towels, such as face towels, paper hand towels and the like, such towels being interfolded with one another in a zigzag manner, said apparatus comprising means for detecting the markings provided on the stack, means for separating a partial stack from the total stack, and means for discharging and depositing a partial stack comprising a pair of lifting forks supported for pivotal movement and displaceable laterally, a pair of transport forks displaceable laterally, and a depositing table equipped with a retention means disposed within the zone of the front edge of the depositing table and comprising a pin extendable vertically beyond the top edge of the depositing table for retaining the partial stack deposited thereon.

4. Apparatus for dividing a moving stack of flexible workpieces, having detectable markings thereon, into partial stacks comprised of a predetermined number of workpieces, in particular in the manufacture of towels, such as face towels, paper hand towels and the like, such towels being interfolded with one another in a zigzag manner, said apparatus comprising means for detecting the markings provided on the stack, means for separating a partial stack from the total stack, means for discharging and depositing a partial stack, and means for turning over the top sheet of the partial stack which is arranged within the transfer zone between the means for separating a partial stack from the total stack and, the means for discharging and depositing the partial stack.

5. The apparatus as defined in claim 4, wherein the means for turning over the top sheet of the stack comprises an extendable rod extending in the extended condition in about the center of the space between the top edge of the stack and the bottom edge of the partial stack taken over by the separating means, and blowing nozzles arranged approximately on the level of the rod within the zone of the depositing table.

* * * * *